US006595497B1

(12) United States Patent
Linford et al.

(10) Patent No.: US 6,595,497 B1
(45) Date of Patent: Jul. 22, 2003

(54) VINYL BEAM REINFORCEMENT APPARATUS AND METHOD

(76) Inventors: Paul M. Linford, 3795 S. Ruth Dr., Salt Lake City, UT (US) 84124; Duane M. Linford, 3468 E. 7550 South, Salt Lake City, UT (US) 84121; Khaled Mahjoub, Hosh Blas Sbench Bridge, P.O. Box 177, Damascus (SY)

( * ) Notice: Subject to any disclaimer, the term of this patent is extended or adjusted under 35 U.S.C. 154(b) by 151 days.

(21) Appl. No.: 09/788,322

(22) Filed: Feb. 16, 2001

Related U.S. Application Data

(60) Provisional application No. 60/181,384, filed on Feb. 9, 2000.

(51) Int. Cl.[7] ..... E04H 17/14
(52) U.S. Cl. ..... 256/19
(58) Field of Search ..... 256/19, 24, 65, 256/66, 69, 73, 1, 13.1, 50

(56) References Cited

U.S. PATENT DOCUMENTS

| | | | | | |
|---|---|---|---|---|---|
| 3,557,509 | A | | 1/1971 | Blaski | 52/489 |
| 4,704,828 | A | | 11/1987 | Kemp | 52/107 |
| 5,702,090 | A | * | 12/1997 | Edgman | 256/19 |
| 5,755,431 | A | * | 5/1998 | Williams | 248/523 |
| D405,545 | S | | 2/1999 | Forbis | D25/126 |
| D405,546 | S | | 2/1999 | Forbis | D25/126 |
| 5,873,671 | A | | 2/1999 | West | 103/232.1 |
| 5,884,960 | A | * | 3/1999 | Wycech | 296/146.6 |
| 5,988,599 | A | | 11/1999 | Forbis | 256/24 |
| 5,996,293 | A | | 12/1999 | Anderson et al. | 52/215 |
| 6,041,486 | A | | 3/2000 | Forbis | 29/453 |
| 6,070,375 | A | | 6/2000 | Anderson et al. | 52/204.54 |
| 6,173,944 | B1 | * | 1/2001 | McCarthy | 256/19 |
| 6,189,269 | B1 | * | 2/2001 | De Zen | 52/220.1 |
| 6,270,600 | B1 | * | 8/2001 | Wycech | 156/79 |
| 6,299,142 | B1 | * | 10/2001 | Chaney et al. | 256/19 |
| 6,328,284 | B2 | * | 12/2001 | Wilding | 256/1 |
| 6,341,467 | B1 | * | 1/2002 | Wycech | 296/187 |
| 6,421,979 | B1 | * | 7/2002 | Fischer et al. | 403/363 |

* cited by examiner

*Primary Examiner*—Robert E. Pezzuto
(74) *Attorney, Agent, or Firm*—Kunzler & Associates

(57) ABSTRACT

An apparatus and method for reinforcing vinyl beams provides rigidity, strength, and security for vinyl beams used in fencing and other applications. The apparatus is a shaped thermoplastic beam which is formed to contain a cavity and at least one retaining member. The retaining member may be contained within the cavity to form a slot adapted to receive a reinforcing member. The retaining member may be a pair of lips attached to opposing walls of the thermoplastic beam and may also be a wall running inside the cavity. The reinforcing member may be substantially planar so as to be inserted into the cavity by threading the member within the slot or sheath created by the opposing lips or parallel walls. A method of the present invention for reinforcing a thermoplastic beam includes providing a thermoplastic beam containing a number of retaining members forming a slot which is capable of receiving a reinforcing member, and inserting a previously selected number of reinforcing members into the slots at the time of installation.

24 Claims, 15 Drawing Sheets

VINYL BEAM REINFORCEMENT APPARATUS AND METHOD

This application is a Continuation-In-Part of and claims priority to U.S. Provisional Patent Application Ser. No. 60/181,384, filed on Feb. 9, 2000, for Vinyl Beam Reinforcement Apparatus and Method.

BACKGROUND OF THE INVENTION

1. The Field of the Invention

The present invention relates to devices for reinforcing vinyl beams. More specifically, the present invention relates to reinforcing vinyl beams, both vertically and horizontally, such that the vinyl beam does not sag, bow, or bend when loaded with weight and is more difficult to penetrate.

2. The Relevant Art

Vinyl fencing has become increasingly popular over the past few years, both in residential and commercial applications. The appeal to the consumer is obvious—once the initial installation is complete, the finished product is both attractive and maintenance-free, or at least the desired application embodies these characteristics. Vinyl is not biodegradable, and hence requires no surface treatment for upkeep, as would, for example, a wooden fence. Furthermore, vinyl fencing does not become discolored over time, making it an ideal material for use in permanent fencing applications.

However, a number of problems are inherent in the current state of the art, including the fact that the typical vinyl beams used as upper, lower, and fencepost rails in vinyl fencing applications lack sufficient structural strength to withstand the downward exertion of gravitational forces over time. The result is that the fence rails and posts sag, bow, bend, or become otherwise deformed, resulting in unsightly, unattractive fences. Additionally, the vinyl fencing beams are relatively soft and are easily penetrated by common tools, such as a rotary blade saw, thus reducing the effectiveness of vinyl fencing as a deterrent to ingress to and egress from the fenced area.

A further functional problem caused by the insufficient structural strength of the vinyl beam members becomes evident when the vinyl fence section functions as a gate within a fence. In such an application, the sagging or other deformity often renders the gate inoperable because the resulting sagging in the bottom rail can prevent the gate from being moved, or at least can dramatically increase the exertion necessary to move the sagging gate over the underlying terrain.

Yet another problem exists in applications where vinyl beams are incorporated into window frames. In such applications, the deformity caused by insufficient structural strength of the vinyl beam members is even more grave. Where the window frame becomes deformed, the ability to open and close the window can be jeopardized, thus dramatically reducing the usefulness of the application.

In the construction of one application of vinyl fencing, the technician first secures the vertical posts into the terrain underlying the fence, usually using a concrete mix. Once the vertical posts have become sufficiently secure and rigid, the upper and lower fence rails are inserted into the vertical posts, so as to run parallel to each other and perpendicular to the vertical fence posts, one on each end of the rails. Slats are then cut to fit between the upper and lower rails and are inserted between the rails, finishing the fence. Because the slats are cut to fit between the upper and lower rails and are inserted after the horizontal rails and vertical posts have been installed, the slats are somewhat shorter than the distance between the most distal internal end-points of the receiving mechanism of the upper and lower fence rail.

Gravity causes the slats to exert a downward force upon the lower fence rail. Accordingly, if the horizontal rails sag, bend, or otherwise become deformed, the slats tend to settle downward on the lower rail, thus causing a gap to occur between the top of the slats and the bottom of the upper rail. This gap is both unsightly and structurally problematic, in the latter sense, because absent the exertion of the retaining members of the upper fence rail, the fence slats may be easily removed. Accordingly, much of the value of the fencing application is lost in that the fence loses the ability to deter ingress to and egress from the fenced area.

One existing device for preventing the settling of slats and the resultant gap between slats and the upper rail member comprises using protruding tabs cast into the slats during the manufacturing process, which protruding tabs are inserted into one or more receiving lips inherent in the upper fence rail. This device may well be effective for eliminating the gap between the slats and an upper rail member. However, such a device or system does little to prevent the sagging of the fence rails, which in this case often results in the entire section of fence sagging in a parallel fashion.

The other likely result is that a gap can develop between the slats and the lower fence rail. In either scenario, the device does not satisfactorily address the problem of sagging due to the insufficient the structural strength of the vinyl beam members. Furthermore, the device does nothing to reinforce the vinyl beams resulting in an increased deterrent to ingress to and egress from the fenced area. In sum, the device or system described in this paragraph falls short of addressing the problems inherent in the current state of the art.

From the above discussion, it can be seen that a need exists for an improved apparatus and method for reinforcing vinyl beams, both vertically and horizontally, such that the vinyl beam does not sag, bow, or bend when loaded with weight and is more difficult to penetrate.

OBJECTS AND BRIEF SUMMARY OF THE INVENTION

The device and method of the present invention have been developed in response to the present state of the art, and in particular, in response to the problems and needs in the art that have not yet been fully solved by currently available devices and methods. Accordingly, it is an overall object of the present invention to provide a vinyl beam reinforcing device and method that overcome many or all of the above-discussed shortcomings in the art.

To achieve the foregoing object, and in accordance with the invention as embodied and broadly described herein in the preferred embodiment, an improved vinyl beam reinforcing device and method are provided.

The vinyl beam reinforcement apparatus in one embodiment comprises a shaped thermoplastic beam which is formed to contain a cavity and at least one retaining member. The retaining member is preferably formed within the cavity and preferably forms a slot adapted to receive a reinforcing member. In one embodiment, the retaining member is a pair of lips attached to opposing walls of the thermoplastic beam. In an alternative embodiment, the retaining member is a wall running inside the cavity from one outside wall to the other and being located close to either end of the cavity or to the center partition of the cavity. The resulting slot is a fully enclosed sheath in which a reinforcing member may be inserted.

The reinforcing member is, in one embodiment, substantially planar and is inserted into the cavity by threading the member within the slot or sheath created by the opposing lips or parallel walls, respectively.

In operation, the cavity found in the beam may be segregated into two or more smaller cavities by one or more partition walls. The shaped thermoplastic beam contains several sets of lips or parallel walls, which form slots or sheaths and are capable of receiving multiple reinforcing members, according to the strength requirements of the particular application. In this application, the reinforcing member may abut a partition wall or an exterior wall. In either scenario, the reinforcing member preferably runs parallel with the beam.

The most common application will be one in which the vinyl beam is formed of poly vinyl chloride and the reinforcing member comprises a metal strip formed from rolled steel.

In one embodiment of the invention, the thermoplastic body comprises a fence rail and the reinforcing member is a metal strip. The metal strip is employed for the purpose of substantially preventing the fence rail from sagging and, in general, to reinforce the fence rail.

Also integral to the invention is a method of reinforcing a thermoplastic beam, including in particular providing a thermoplastic beam which contains a number of retaining members, where the retaining member form a slot which is capable of receiving a reinforcing member, and inserting a previously selected number of reinforcing members into the slots at the time of installation.

An alternative embodiment of the method comprises the use of a pair of lips attached to opposing walls of the thermoplastic body as the retaining member.

In yet another alternative embodiment of the method, the retaining member comprises a wall running from one outside wall of the cavity to the other, close to either one end of the cavity or to the center partition of the cavity, and forming a fully enclosed sheath in which a reinforcing member is inserted.

BRIEF DESCRIPTION OF THE DRAWINGS

In order that the manner in which the advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

In order that the manner in which the advantages of the invention are obtained will be readily understood, a detailed description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE PREFERRED EMBODIMENTS

A vinyl beam reinforcement apparatus of the present invention is useful in applications where thermoplastic, and particularly poly vinyl chloride (vinyl), extruded or otherwise molded beams (also referred to as "profiles") are required to exhibit increased strength. Certain embodiments of a vinyl beam reinforcement apparatus of the present invention are shown by way of example in FIGS. 1 through 11. Certain embodiments of the vinyl beam reinforcement method are shown by way of example in the flow chart diagram of FIG. 12.

Figure 1:
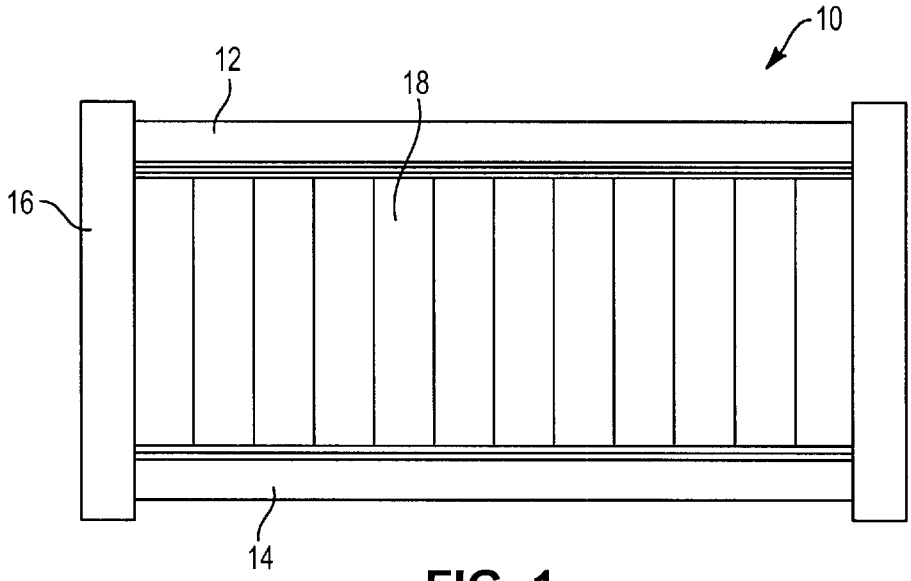
FIG. 1 is a side view of a typical section of vinyl fencing enclosing a plurality of fence slats between two opposing terminal fence posts and an upper and lower fence rail.

Shown in FIG. 1 is a standard vinyl fence 10 of the prior art incorporating the vinyl beam reinforcement apparatus of the present invention. As depicted, the vinyl fence 10 includes an upper rail 12 and a lower rail 14 which connect to upright post members 16. The post members 16 are secured to the ground or to a base material such as a concrete pad or a deck. Disposed between the upper and lower rails 12, 14 are a plurality of panels 18. In the depicted embodiment, the panels 18 extend upward vertically, but could, of course, also be disposed horizontally or set at another selected angle with respect to the ground.

Figure 2:
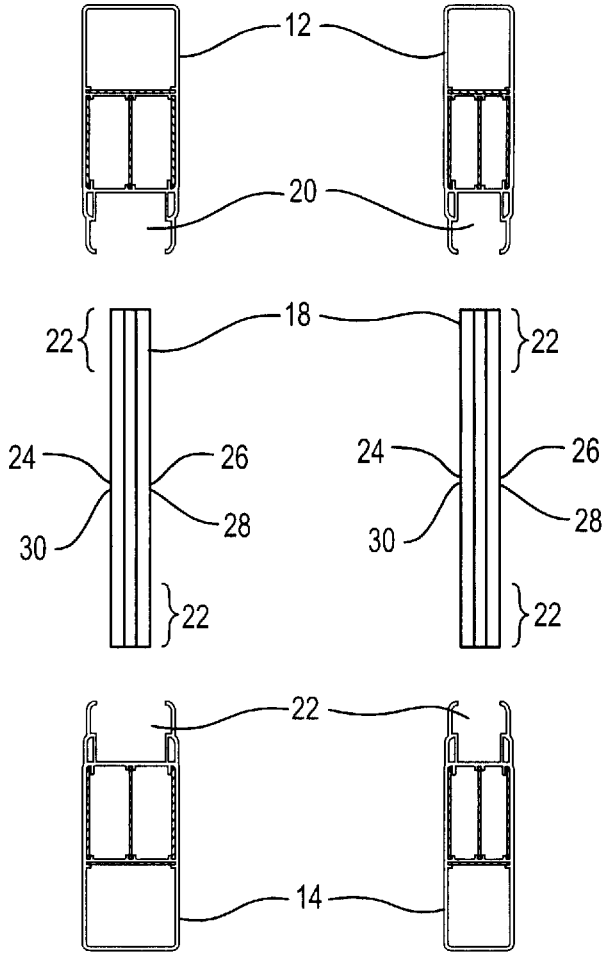
FIG. 2 is a cross-sectional exploded view of an upper and lower fence rail of the present invention showing one manner of connecting the upper and lower rails to the fencing slats.

FIG. 2 is a partial cross-sectional exploded view of an upper rail 12, a lower rail 14, and a single panel 18 showing one manner of connecting the panel 18 with the upper and lower rails 12, 14. As shown, the upper and lower rails 12, 14 are each provided with a channel 20. Distal ends 22 of the panel 18 are disposed within the channel 20, securing the panels 18 in place between the upper and lower rails 12, 14.

Of course, this is but one arrangement in which reinforced vinyl beams of the present invention may be employed. Other arrangements include picket type fences with spaced apart pickets disposed upper and lower rails, post and rail fences in which upright posts support horizontally extending rails, lattice fences with a molded lattice structure disposed between upright posts and upper and lower rails, and combinations of these types of fences. The vinyl fence 10 of FIG. 1 is a privacy fence, and thus, the panels 18 are disposed adjacent each other. Of course, the panels could also be spread apart to leave gaps of selected sizes between the panels.

Figure 2A:
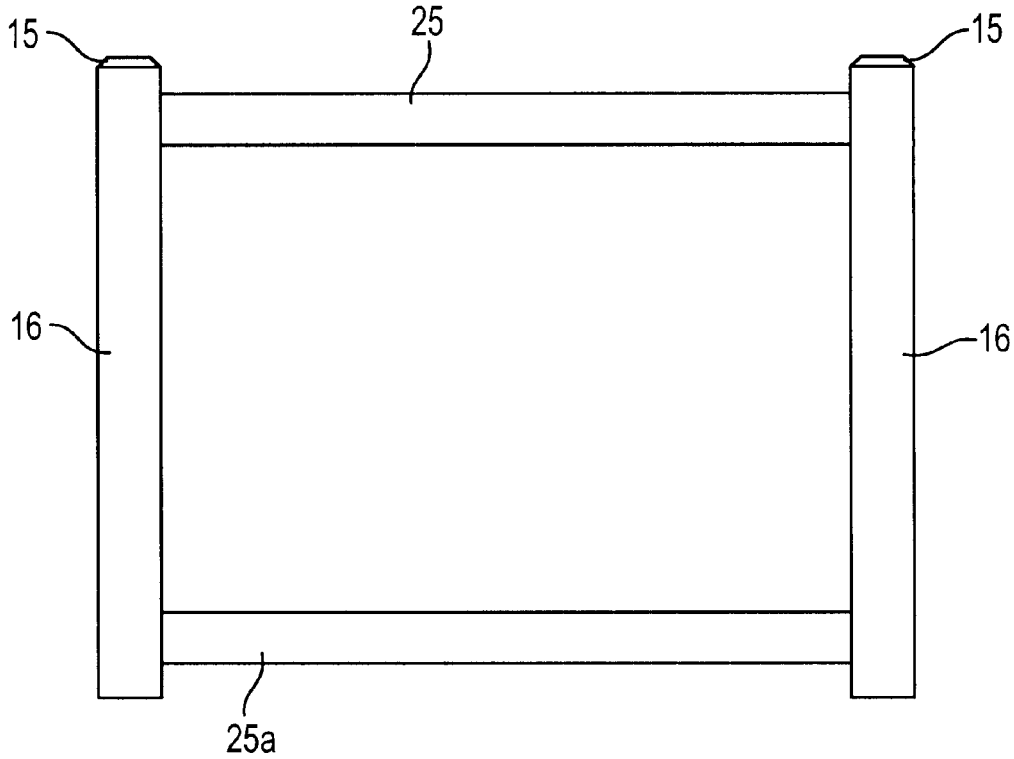
FIG. 2*a* is a side view of one embodiment of a typical vinyl fence application, where one or more fence rails are dispersed between two vertical posts.

Supports and dividers as are used in one embodiment on decks of houses may also be constructed with the reinforced vinyl beams of the present invention. Such Supports may be formed with upright post members and one or more rails dispersed therebetween. Such an arrangement is shown in FIG. 2*a*. Two upright post members 16 support a handrail 25 mounted therebetween and are provided at the top thereof with caps 15. Of course, the handrail 25 may also be mounted to a wall, as in the case of a bannister, and could also be mounted atop a fence or gate. In FIG. 2*a*, a bottom rail 25*a* is also shown. Pickets may also be located between the handrail 25 and the bottom rail 25*a*. The pickets may be reinforced in accordance with the present invention. Additionally, the vinyl or plastic beams of the present invention may also be used in window frames and other applications in which a sturdy, elongated thermoplastic beam is advantageously utilized.

FIGS. 3 through 7 show manners of reinforcing vinyl beams of the present invention and are shown in conjunction with the panels 18, upper and lower rails 12, 14, handrails 25, and upright posts 16 of FIGS. 1 and 2. Manners of reinforcing similar plastic and vinyl beams under the present invention should be readily apparent from these examples.

Figure 3:
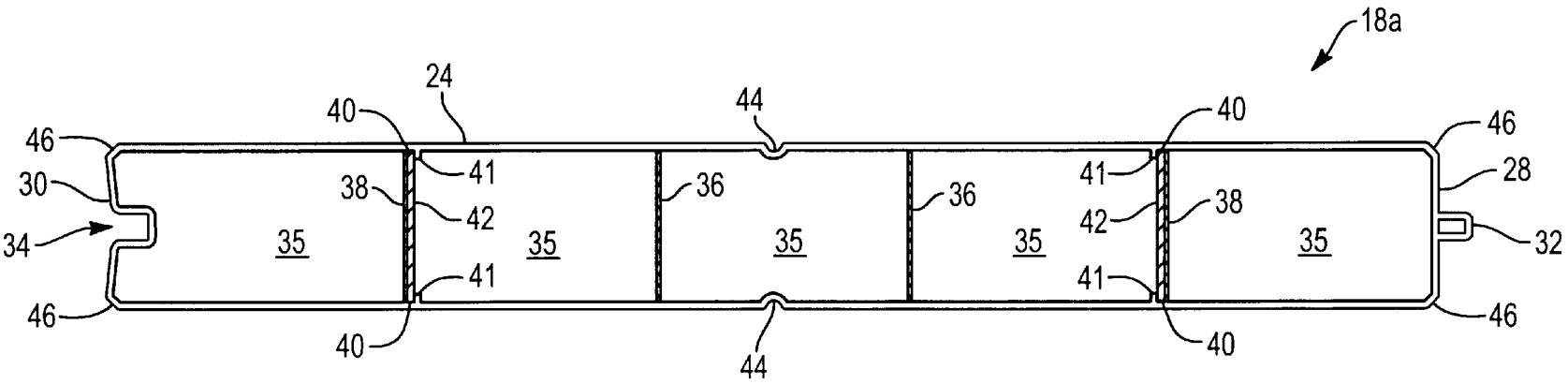
FIG. 3 is a side cross-sectional view of one embodiment of a heavy fence panel suitable for use as a slat in the vinyl fence depicted in FIG. 1.
Figure 4:
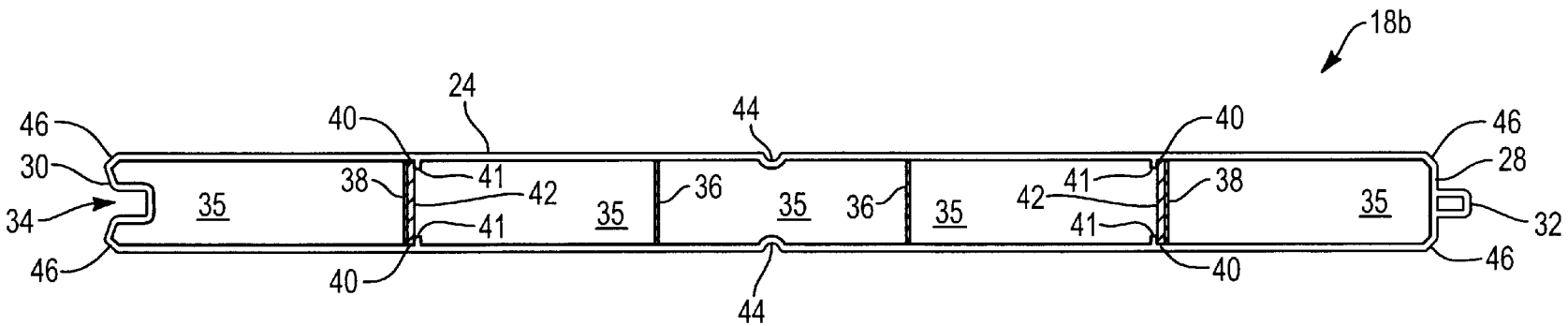
FIG. 4 is a side cross-sectional view of one embodiment of a light fence panel suitable for use as a slat in the vinyl fence depicted in FIG. 1.

In FIG. 3, a heavy panel 18*a* is shown. The heavy panel 18*a* is suitable for use as a panel 18 of the fence 10 of FIG. 1. A similar, thinner, light panel 18*b* is shown in FIG. 4. The panels 18*a*, 18*b* are similarly constructed and each comprises a distal side 24, a proximal 26, a right side 28, and a left side 30. In addition, a protruding tab 32, extending from the right side 28 is adapted to fit modularly within a notch 34 of an adjacent panel. Similarly, a notch 34 of the left side 30 of the panels 18*a*, 18*b* is adapted to receive a notch 34 of an adjacent panel. Of course, where the panels 18*a*, 18*b* are intended to be placed in spaced configurations, the tabs 32 and notches 34 are not necessary.

The panels 18*a*, 18*b* are preferably hollow, exhibiting a cavity 35. In the depicted embodiments, the cavity 35 is broken up by a plurality of inner walls 36, 38. Adjacent to selected walls 38 are slots 40 formed with lips 41. Of course, the slots 40 and lips 41 could be arranged in the cavity 35 other than next to a wall 38. The slots 40 are so sized and shaped as to receive therein a reinforcing member 42. In the depicted embodiments, the tops and/or bottoms of the panels 18*a*, 18*b* are open so as to allow the members 42 to be slid into place within the slots 40 after extrusion or other manners of formation of the panels 18*a*, 18*b*. The reinforcing members 42 may be formed of steel, aluminum, or any other suitable reinforcing material, though metal, and particularly steel are presently preferred.

Figure 5:
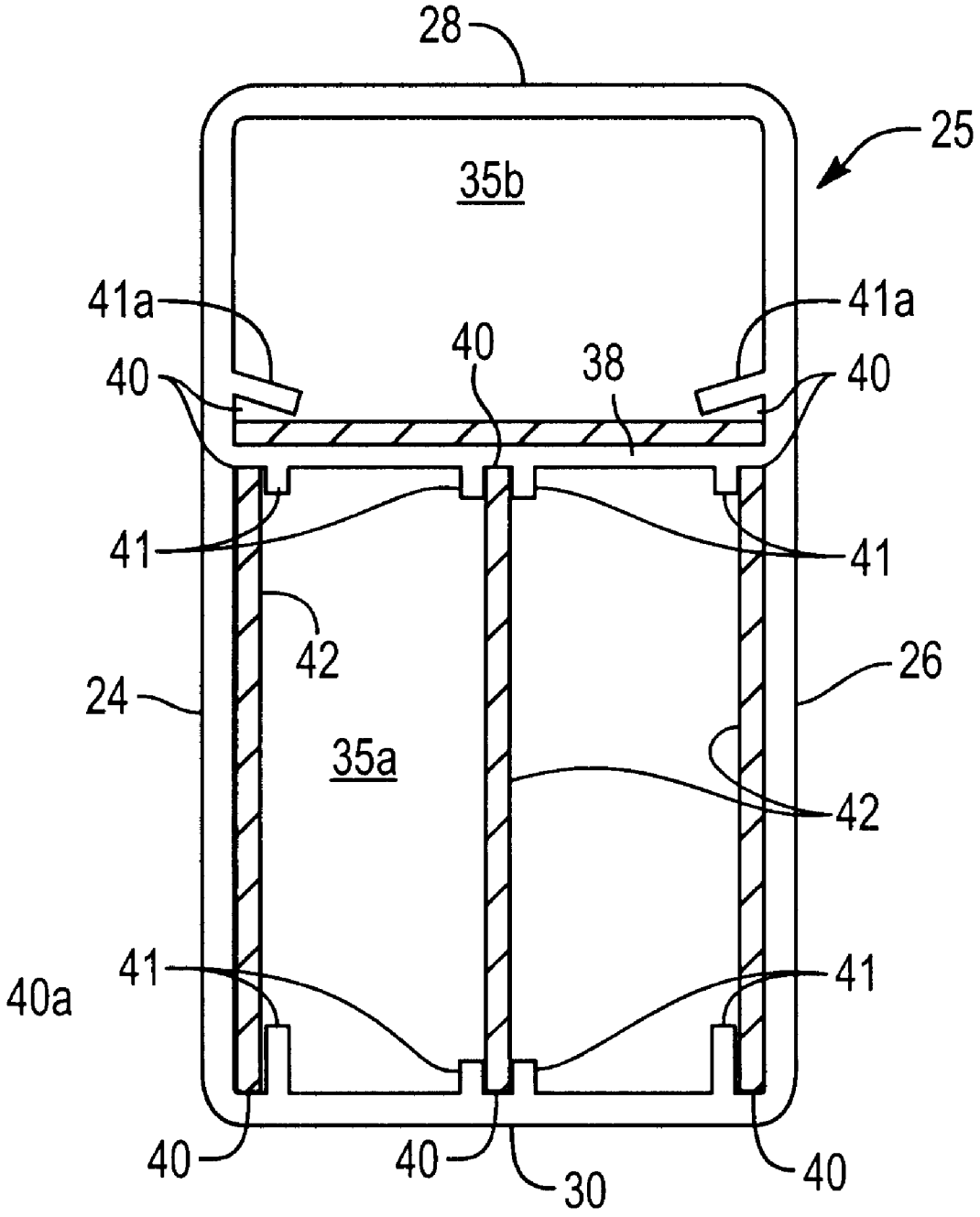
FIG. 5 is a front cross-sectional view depicting one embodiment of a reinforced rail of the present invention suitable for use, for example, as an upper or lower fence railing.
Figure 5A:
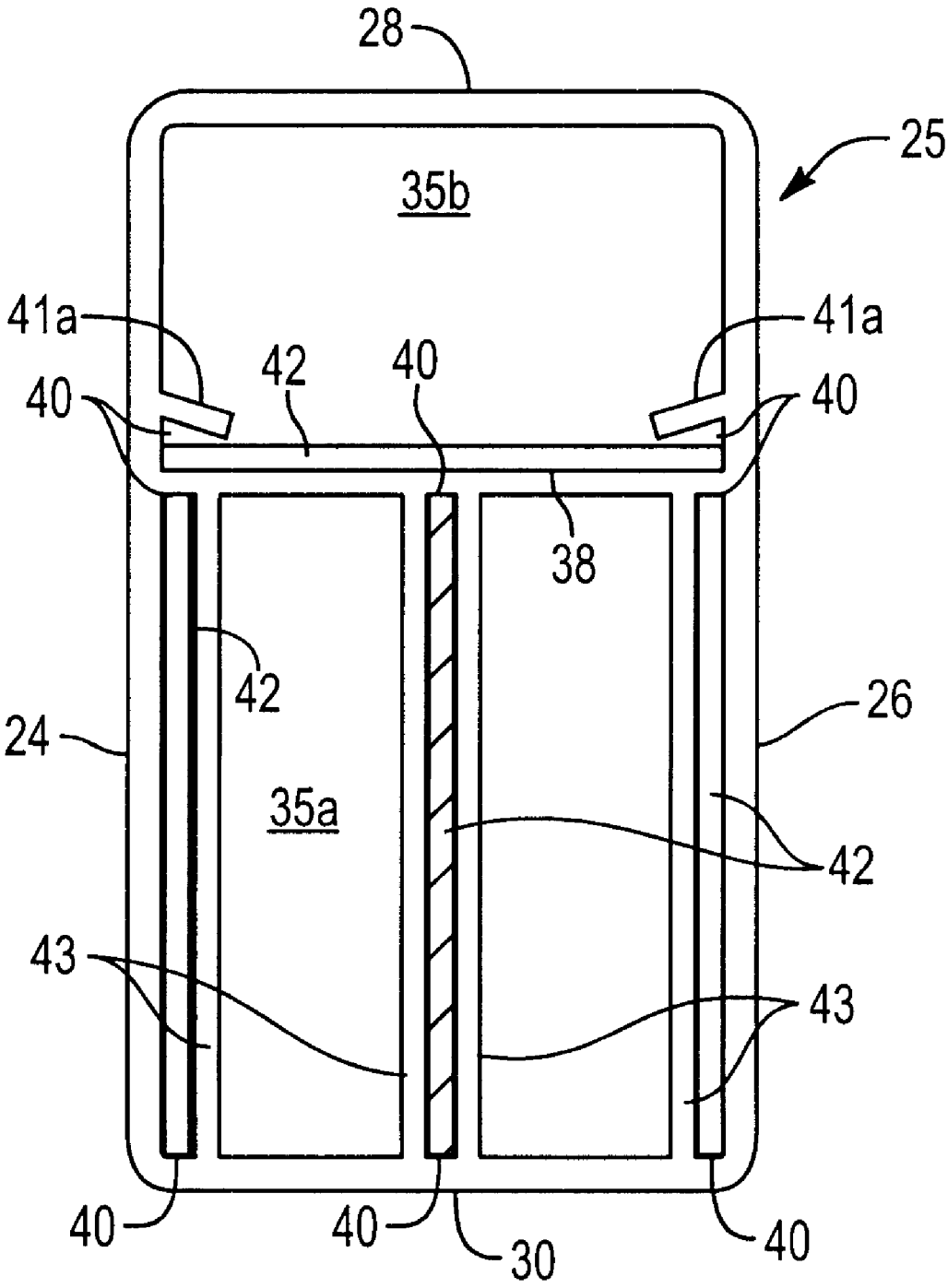
FIG. 5*a* is a front cross-sectional view depicting an alternative embodiment of a reinforced rail of the present invention suitable for use, for example, as an upper or lower fence railing.
Figure 6:
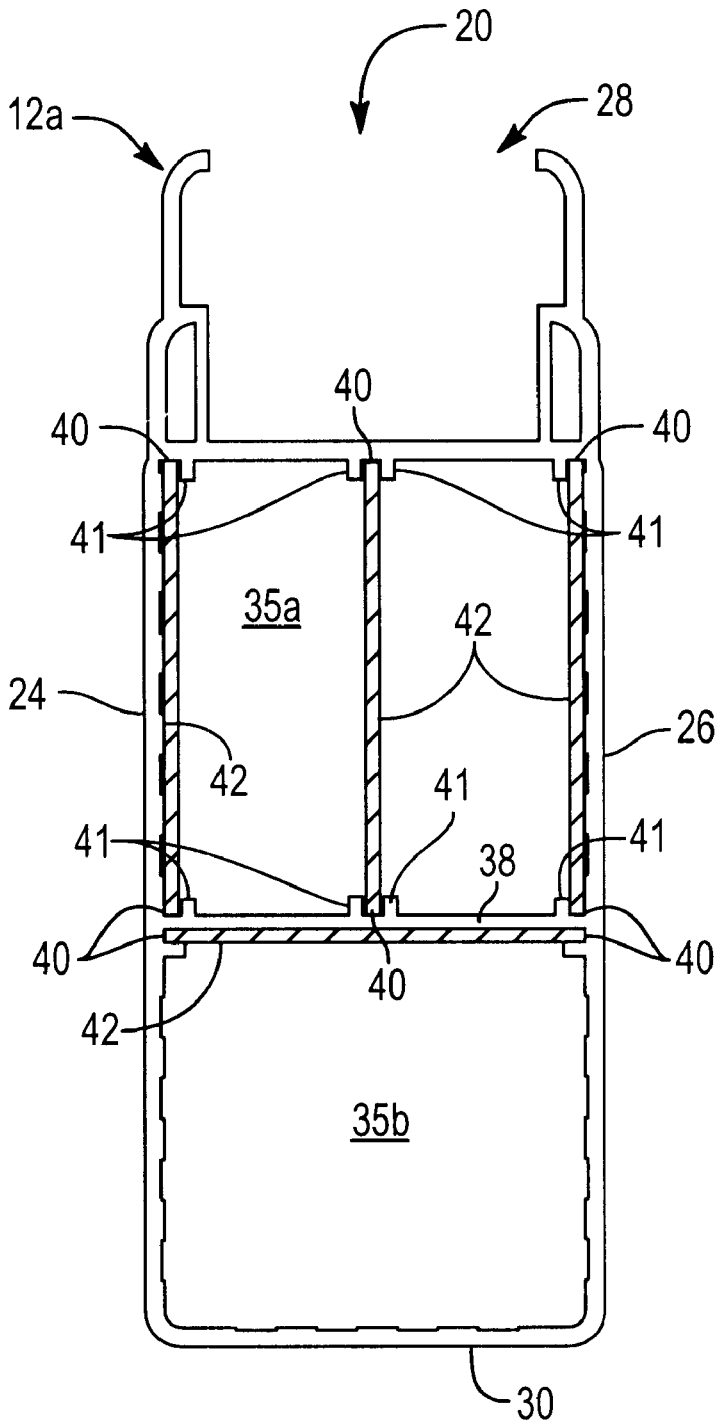
FIG. 6 is a front cross-sectional view depicting another embodiment of a reinforced rail of the present invention suitable for use, for example, as an upper or lower fence railing.
Figure 6A:
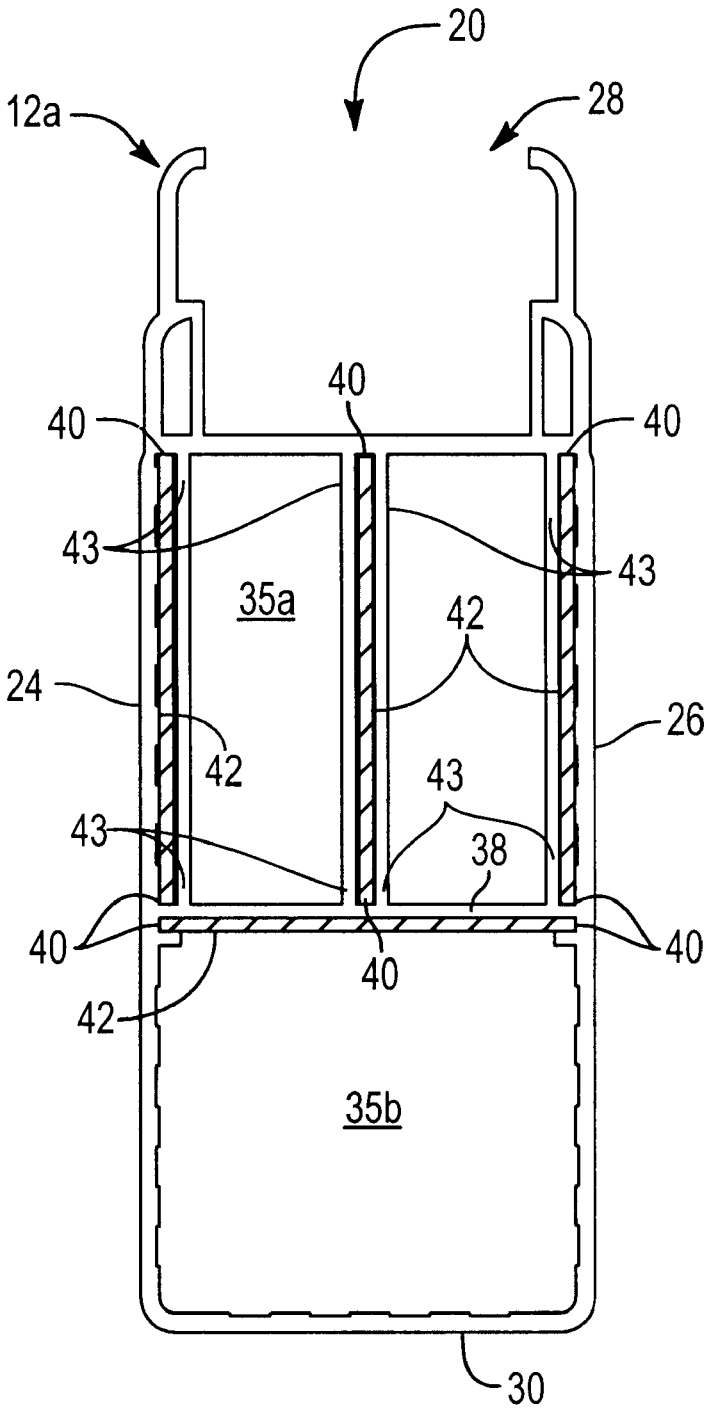
FIG. 6*a* is a front cross-sectional view depicting another embodiment of a reinforced rail of the present invention suitable for use, for example, as an upper or lower fence railing.

Embodiments of rails 12*a*, 12*b* are shown in FIGS. 5 and 6. The rails 12*a* and 12*b* are suitable for use, for example, as upper and lower rails 12, 14 of the fence 10 of FIG. 1. The rails 12*a*, 12*b* are provided with a distal side 24, a proximal 26, a right side 28, and a left side 30. Within the rails 12*a*, 12*b* is a cavity 35. The cavity 35 is broken into an upper cavity 35*a* and a lower cavity 35*b* by an interior wall 38. Within the upper cavity 35*a* adjacent the left and right sides 24, 26 are lips 41 forming slots 40 for receiving reinforcing members 42.

Pairs of slots 40 are located for receiving four different reinforcing members 42. These include slots 40*a* for receiving a central reinforcing member 42. Of course, other lips 41 and slots 40 may also be advantageously placed within the cavity 35 in order to provide reinforcement where needed. Additionally, of course, the configurations of the slots 40 in the upper cavity 35*a* and the lower cavity 35*b* could be reversed.

Figure 7:
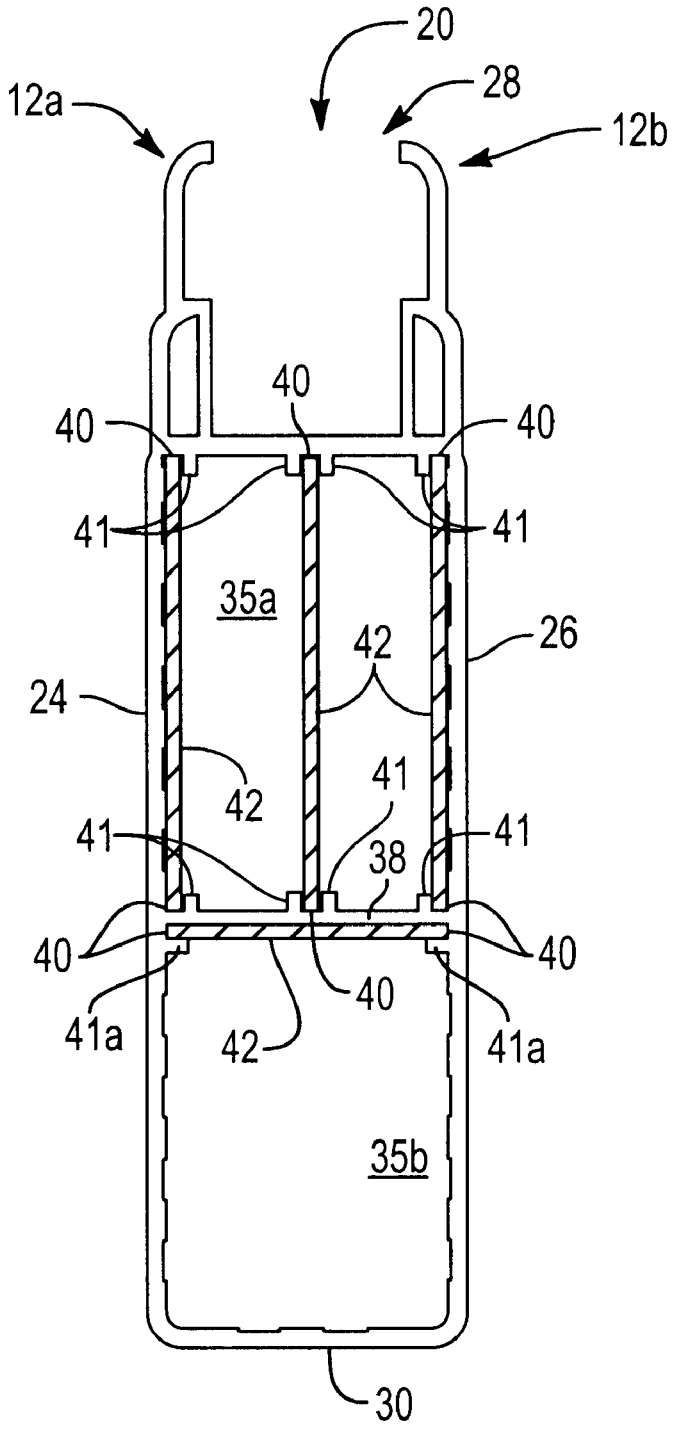
FIG. 7 is a front cross-sectional view depicting another embodiment of a reinforced rail of the present invention suitable for use, for example, as an upper or lower fence railing.
Figure 7A:
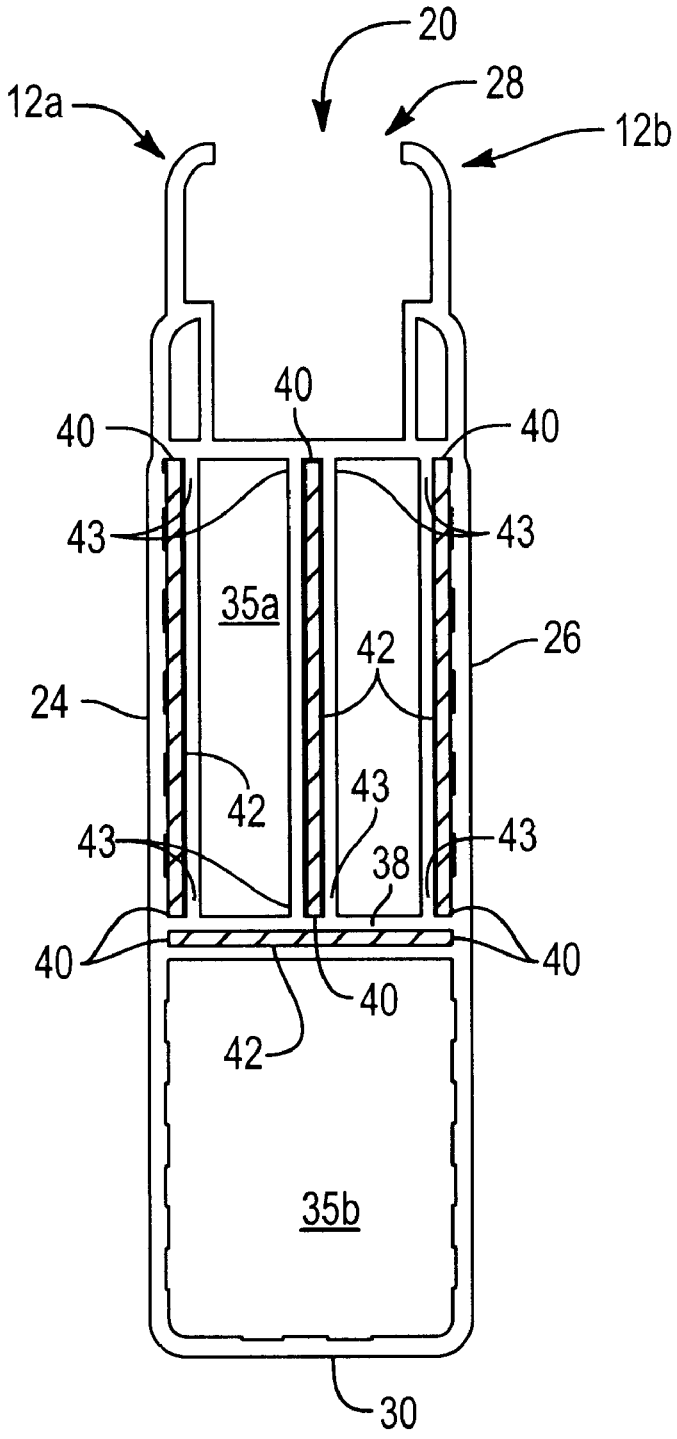
FIG. 7*a* is a front cross-sectional view depicting another embodiment of a reinforced rail of the present invention suitable for use, for example, as an upper or lower fence railing.

FIG. 7 shows a handrail 25 similar to the handrail 25 of FIG. 2*a*. The handrail 25 is provided with a distal side 24, a proximal 26, a top side 28, and a bottom side 30. Within the handrail 25 is a cavity 35. The cavity 35 is broken into an upper cavity 35*a* and a lower cavity 35*b* by an interior wall 38. Within the lower cavity 35*a* adjacent the left and right sides 24, 26 are lips 41 forming slots 40 for receiving reinforcing members 42. Adjacent the internal wall 38 are lips 41*a* and slots 40 for receiving an additional reinforcing member 42. The lips 41*a* are shown protruding in a perpendicular manner but may also slant inward towards the internal wall 38 in order to apply pressure to the reinforcing member 42, maintaining the reinforcing member 42 in position. Slanted lips 41*a* are also considered useful for accommodating differing thicknesses of reinforcing members 42.

Figure 8:
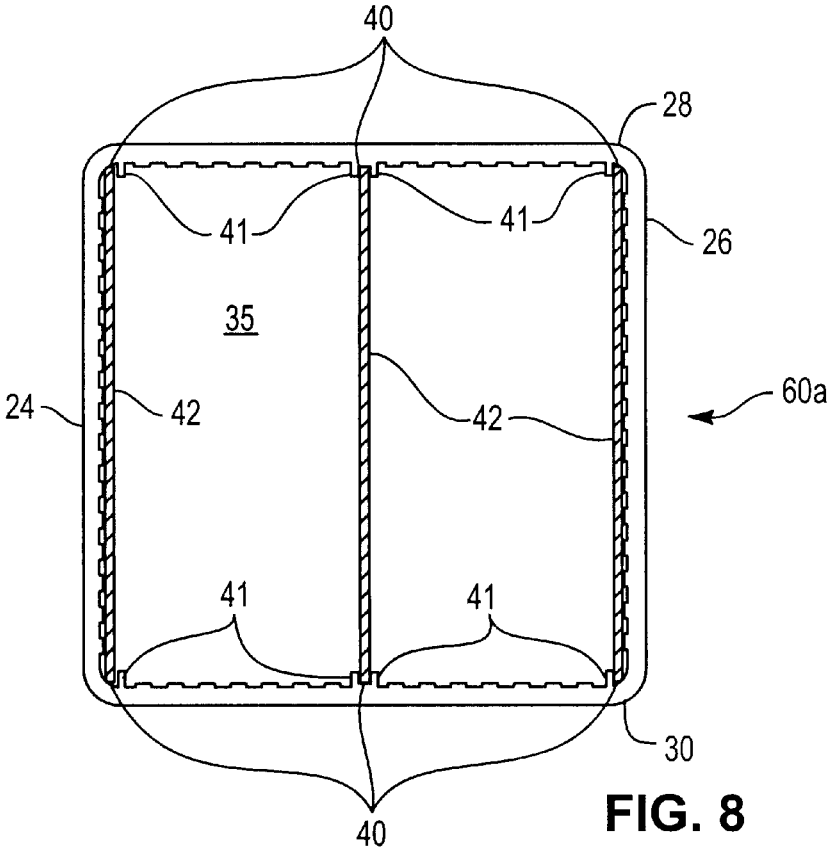
FIG. 8 is a front cross-sectional view depicting one embodiment of a reinforced vinyl beam of the present invention, exhibiting only a single cavity unbroken by internal partition walls.
Figure 9:
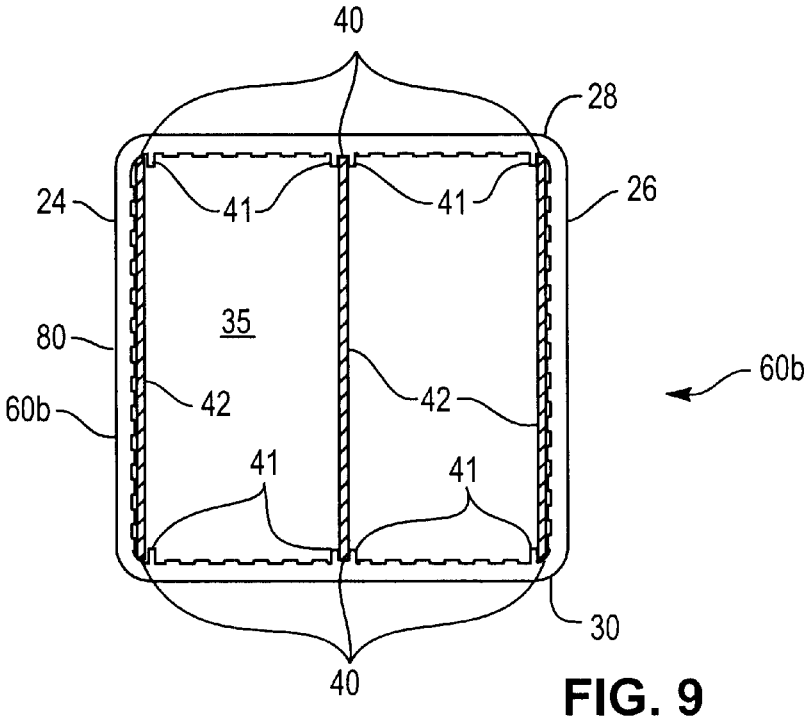
FIG. 9 is a front cross-sectional view depicting an alternative embodiment of a reinforced vinyl beam of the present invention, exhibiting only a single cavity unbroken by internal partition walls.
Figure 9A:
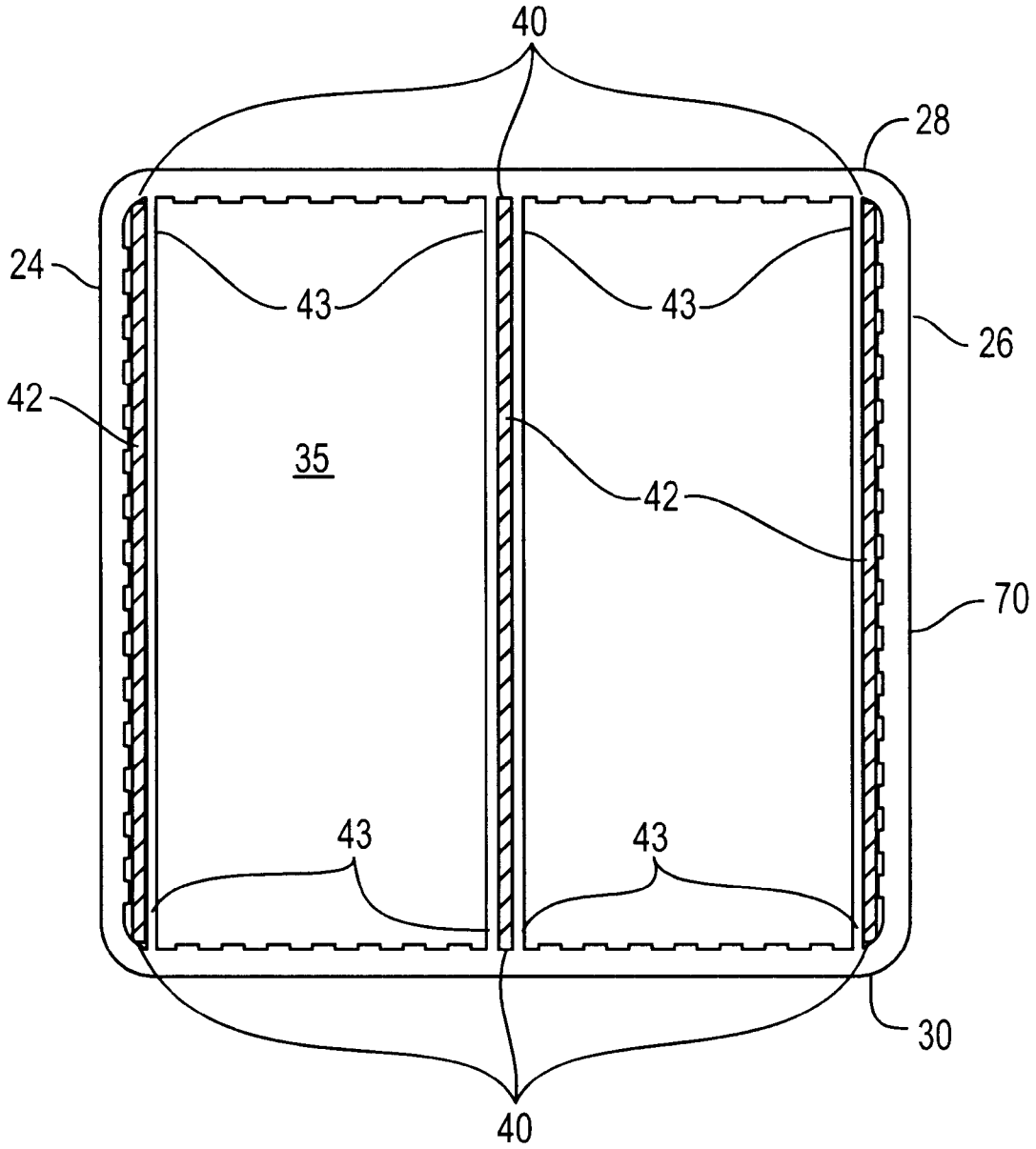
FIG. 9*a* is a front cross-sectional view depicting another alternative embodiment of a reinforced vinyl beam of the present invention, exhibiting only a single cavity unbroken by internal partition walls.

FIGS. 8 and 9 show alternate embodiments of the reinforced vinyl beam of the present invention. In the embodiments of FIGS. 8 and 9, the beams 60*a*, 60*b* exhibit only a single cavity 35, unbroken by internal walls. Rather, the cavities are divided by a central reinforcing member 42. Other reinforcing members are also preferably disposed adjacent exterior walls of the beams 60*a*, 60*b*. The beams 60*a*, 60*b* may be used as posts 16, hand rails 25, or other suitable applications.

Figure 10:
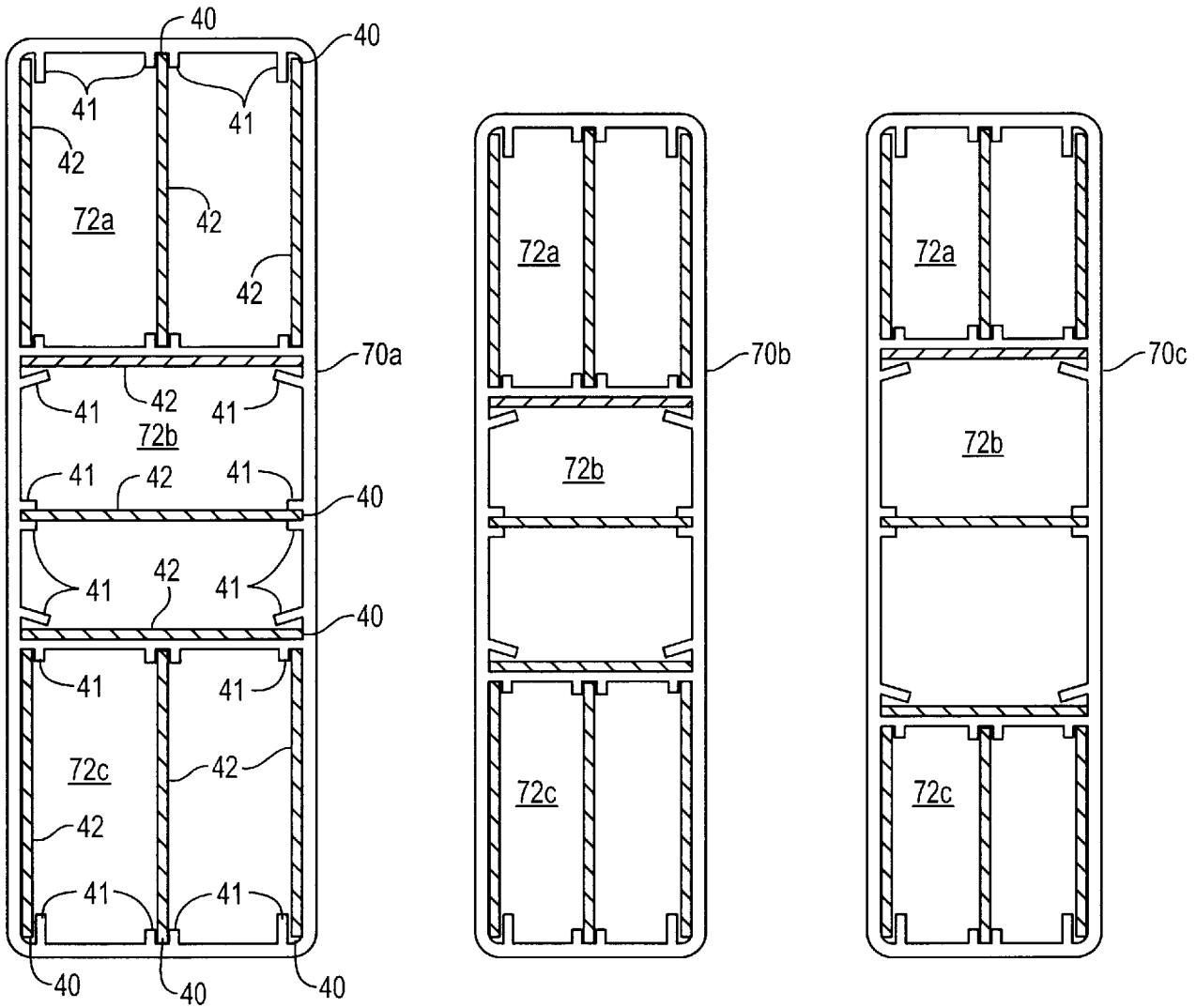
FIG. 10 is a front cross-sectional view depicting other alternative embodiments of the reinforced vinyl beam of the present invention provided with a plurality of retaining members and reinforcing members.
Figure 10A:
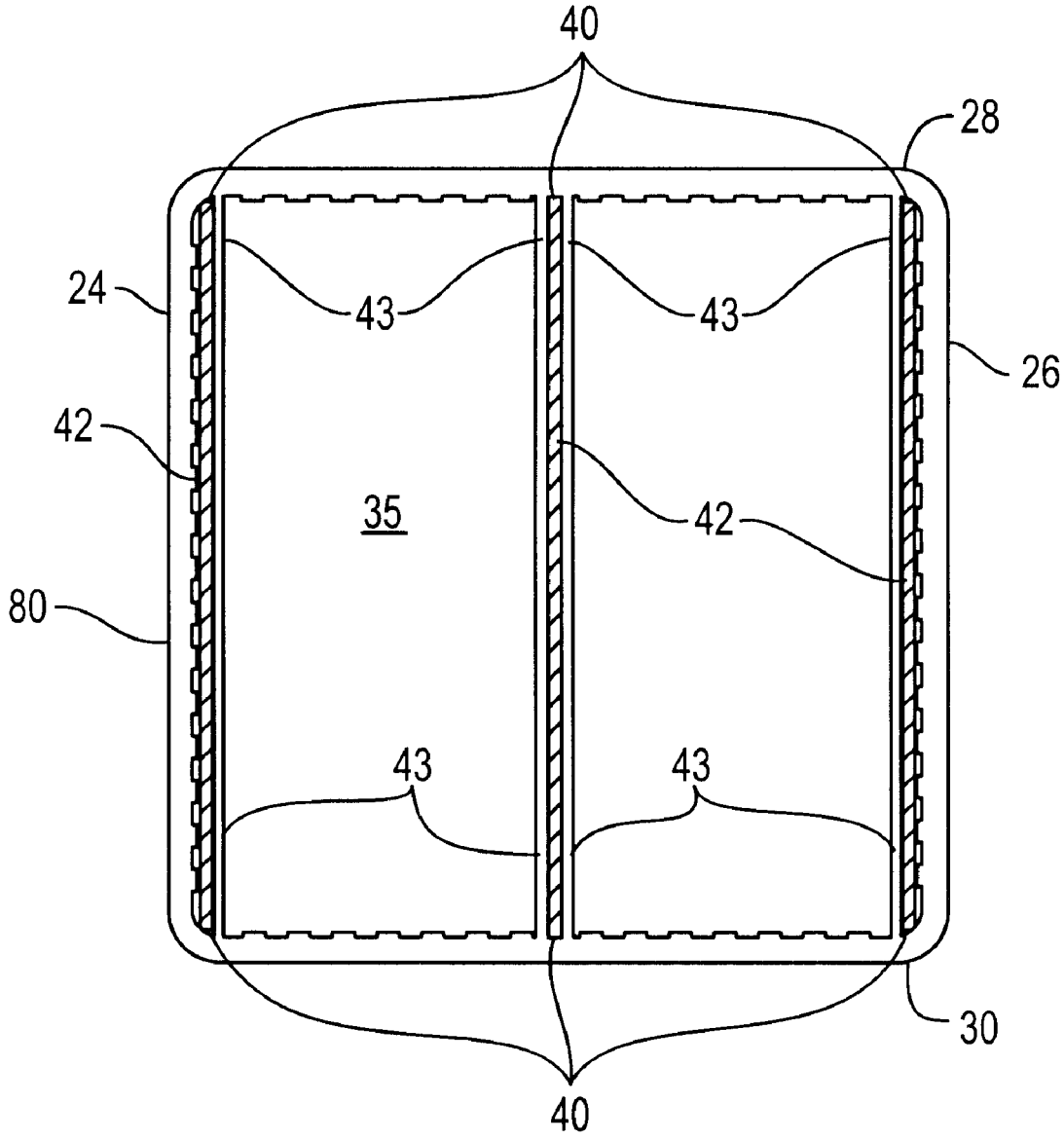
FIG. 10*a* is a front cross-sectional view depicting another alternative embodiment of a reinforced vinyl beam of the present invention, exhibiting only a single cavity unbroken by internal partition walls.
Figure 11:
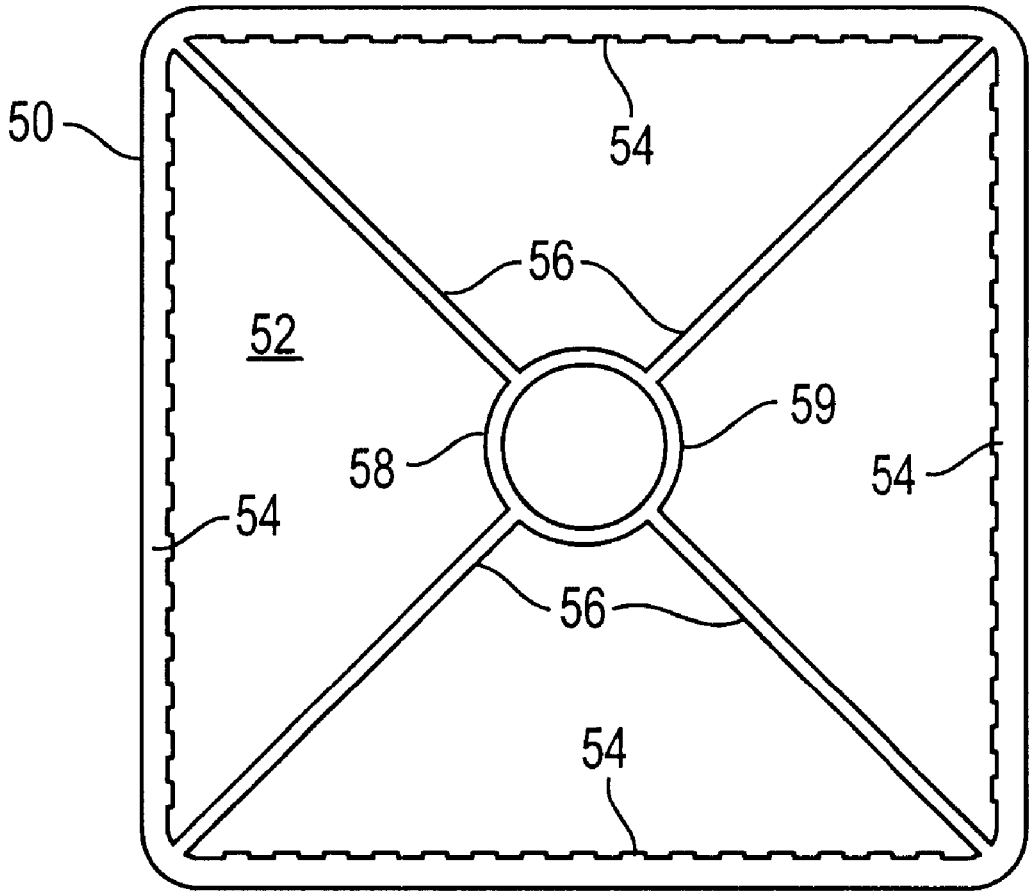
FIG. 11 is a front cross-sectional view depicting one embodiment of the reinforced vinyl beam of the present invention useful, for instance, as an upright post of the fence of FIG. 1.

FIG. 10 shows other alternate embodiments of the reinforced vinyl beam of the present invention. In the embodiments of FIG. 10, vinyl beams 70*a*, 70*b*, 70*c* exhibit a cavity 72 broken into three chambers 72*a*, 72*b*, 72*c*. Within each of the chambers 72*a*, 72*b*, 72*c* are a plurality of slots 40 for receiving reinforcing members 42. The vinyl beams 70*a*, 70*b*, 70*c* are given as an example of a manner of heavily reinforcing a vinyl beam. Of course, not all slots 40 need be present, and a user may select the slots 40 in which reinforcing members 42 are placed. Additionally, of course, more or less cavities 72*a*, 72*b*, 72*c* could be formed. FIG. 11 illustrates that both horizontally disposed and vertically disposed members 42 and corresponding slots 40 may be employed within a given vinyl beam. The beams 70*a*, 70*b*, 70*c* may be used as handrails 25, bannisters, or in other situations where a heavily reinforced vinyl beam is necessary.

While the reinforcing members 42 of the present invention may have bends therein, it is preferred that they be substantially flat and planar. In one embodiment, given by way of example, the reinforcing members 42 comprise elongated strips. Nevertheless, in a further embodiment, the reinforcing members 42 are formed in a U-shape. The reinforcing members may also be formed with an L-shape, a S-shape, a Z-shape, or with any other suitable shape. Under embodiments where the reinforcing members 42 are shaped with bends therein, it is preferred that the distal ends of the reinforcing members are retained within slots 40 formed by lips 41 in the same manner as the distal ends of the depicted members 42 are shown disposed within the slots 40.

The reinforcing members 42 provide stiffness to the panels 18*a*, 18*b* and prevent substantial deformation of the panels 18*a*, 18*b*, such as might cause the panels 18*a*, 18*b* to be forced out of place in a fence 10 in which the panels 18*a*18*b* are located. Additionally, the reinforcing members (or strips) 42 provide security. That is, with fences or structures made purely of vinyl, puncturing the structure with an instrument such as a power saw is relatively easy, and thus, prior art structures are subject to vandalism and breaking and entering of unauthorized persons who merely cut a hole in the structure large enough to enter and break in. So doing with the reinforced vinyl beams of the present invention is very difficult, as a number of metal reinforcement members 42 would have to be cut through to make a hole of significant size.

The flat and planar reinforcing members 42 of the present invention add substantial reinforcement while maintaining a low cost of the vinyl or plastic beams being reinforced. It is much more economical to provide flat reinforcing members 42 than having to roll, form, or otherwise shape the reinforcing members 42. Additionally, any type of metal or reinforcing material may be used, and can be from off-the-shelf sources, rather than having to be specially manufactured. Thus, the reinforcing members 42 are readily available and can be bought in small quantities. Large inventories of reinforcing members 42 are thus not necessary.

The reinforcing members 42 may be of differing gauges, and while preferably fitting snugly within the slots 40, some tolerance is considered to be acceptable and to fall within the scope of the present invention. Additionally, the slots 40 can be varied in width according to the end use. Thus, reinforcing members 42 of greater gauge can be used in applications where greater strength is needed and reinforcing members 42 of lesser gauge can be used in applications where lesser strength is needed. Additionally, as reinforcing members 42 of differing gauges may be retained within the slots 40, the user may decide at the time of installation which gauge of reinforcing members 42 to use.

In one embodiment, the reinforcing members 42 come supplied in a roll cut to a desired width and strips are merely cut one after the other from the end of the roll. In this manner, there is little or no wastage of material as when a full member cannot be cut from the end of a stock member of material.

When used in the fence 10 of FIG. 1, expensive mounting methods such as fastening the top and bottom rails 12, 14 to the panels 18 are not necessary. With the use of the vinyl beam reinforcing apparatus and method of the present invention, sagging, bowing, or deformation of the rails 12, 14 and/or the panels 18 can be substantially eliminated without the need for expensive mounting methods. Thus, the reinforced beams of the present invention are more economical for use in vinyl fences 10 than vinyl fences 10 that utilize prior art mounting and other sag prevention techniques.

It should be noted that in the depicted embodiment, two reinforcing members 42 are shown disposed within each panel. Additionally, lips 41 and slots 40 are provided for those two panels. In alternate embodiments, lips 41 and slots 40 may be provided for more or less than two reinforcing members 42. Additionally, the slots 40 may be made in other manners. For instance, the outside wall of a vinyl beam may be made thicker throughout or in a limited area, and slots may be formed directly into the wall without the need for lips 41. In either case, the slots 40 are preferably of a dimension substantially equivalent to the gauge of a reinforcement member 42 that is to be received therein.

Under the present invention, a plurality of such slots 40 are preferably provided for receiving a plurality of reinforcing members 42. The slots 40 are preferably strategically located in different locations that take differing loads. The decision regarding how many reinforcing members 42 to use and in which slots 40 to place them is then left to the discretion of the installer who may determine into which slots 40 reinforcing members 42 are to be installed in each panel 18*a*, 18*b* according to the needs of the particular application. Thus, the present invention provides a modular and flexible reinforcing system that is adaptable to many types of situations. Therefore, both gauge and position of the reinforcing members 42 are preferably selectable by the user according to the application.

While it is preferred that a single reinforcing member 42 be placed within a single pair of slots 40, multiple reinforcing members 42 could also be placed end-to-end within a pair of slots 40. Additionally, a single reinforcing member 42 could be used to connect a plurality of beams placed adjacent each other. Thus, a pair of slots 40 of a first and second vinyl beam may be aligned and a single reinforcing member 42 passed through the slots 40 of both the first and second vinyl beam to connect the first and second vinyl beam together and strengthen the union of the first and second vinyl beams.

FIGS. 5*a*, 6*a*, 7*a*, 9*a*, and 10*a* show an alternate embodiment of the vinyl beam reinforcement apparatus and method of the present invention. Shown therein are vinyl beams configured substantially as described above, with the exception that certain of the slots 40 for retaining the reinforcing members 42 are formed with walls 43 rather than with the lips 41 shown in other embodiments. Of course, the slots 40 could be formed in any manner, so long as they are suitable for retaining the reinforcing members 42 therein.

Figure 12:
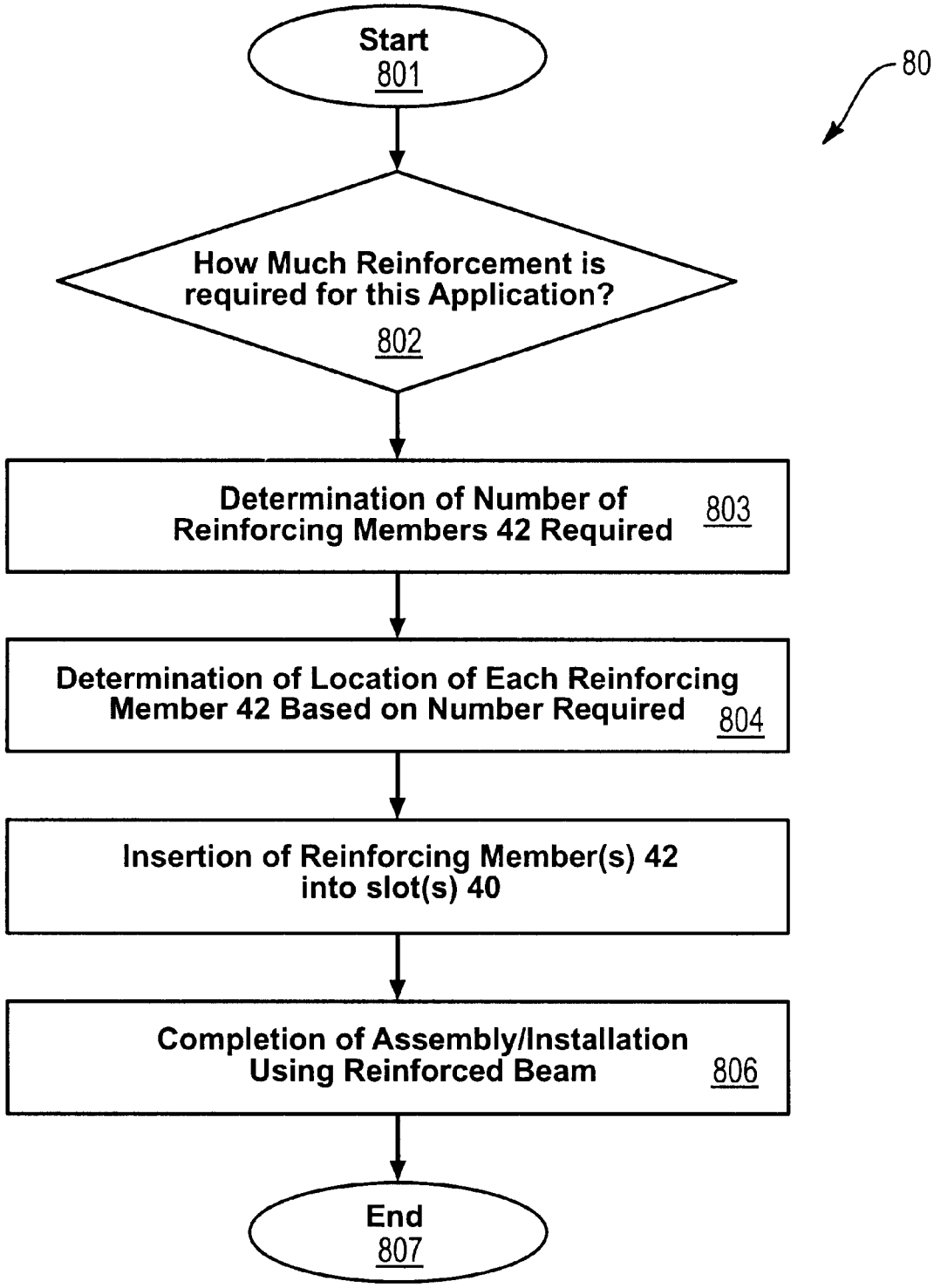
FIG. 12 is a flow chart depicting the process of reinforcing vinyl beams which is the subject of the present invention.

Referring next to FIG. 12, shown therein is one embodiment of the method of reinforcing a thermoplastic beam 80. The method is preferably employed during the installation and/or assembly of an application incorporating a vinyl beam. Initially, as indicated at a block 802, the installer determines how much reinforcement is required for the particular application. This decision is preferably based on how much strength and security are necessary and may be balanced against a cost budget provided.

Next, the installer makes a determination, as indicated at a block 803, of the number of reinforcing members 42 required for the particular application according to the decision of block 802. Based on the outcome of this determination, the installer makes a determination, as indicated at a block 804, of the location of each reinforcing member 42. This determination may be based on the number of reinforcing members indicated by the decision of block 804. It may also be based on particular application needs. For instance, a horizontally disposed reinforcing member provides greater relative strength than a vertically disposed reinforcing member and may be more resistant to penetration.

At a block 805, the installer inserts reinforcing member(s) 42 into slot(s) 40. Upon completion of the insertion of reinforcing member(s) 42 into slot(s) 40, block 805, the installer then completes assembly/installation using the reinforced beam, as indicated at a block 806. At a block 807, the method 80 ends.

Because the reinforcing members do not need to be bent in any particular manner, the manufacture thereof is relatively inexpensive. Additionally, the installation of the reinforced beams is quick and easy. The amount of reinforcement to use is flexible and is preferably left to the installer. Of course, the reinforcing members 42 could be molded within the beams, but it is preferred that they be installed after molding of the beams.

FIG. 11 shows one embodiment of a plastic beam 50 useful, for instance, as an upright post 16 of the fence of FIG. 1. The plastic beam 50 may also be used for a deck railing and other similar uses. The beam 50 is preferably hollow and is provided with an interior 52. Four walls 54 define the outside of the beam. The top and bottom of the beam may be covered with walls or caps or may be left open as shown. Within the beam is shown four diagonal interior walls 56, each emanating from a corner between two walls 54. The diagonal interior walls 56 do not meet, but are connected with a central enclosure 58 which is preferably formed from a continuous wall 59. The central enclosure 58 is shown shaped as a cylinder, but could of course be of other shapes.

Figure 2B:
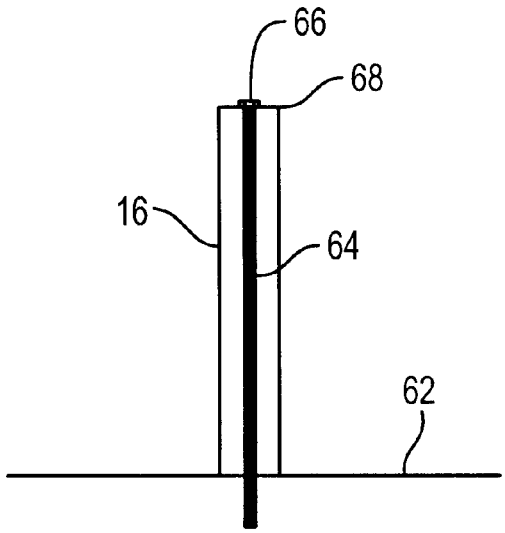
FIG. 2*b* is a phantom view of an upright fence post of the present invention shown anchored to the underlying surface.

The plastic beam 50 is useful for purposes of anchoring a device to the ground as shown in FIG. 2*b*. As shown therein, a beam 50 is used as an upright post 16. The upright post 16 is anchored to the ground by a rod 64 which may be provided partially or in full with threads. The rod 64 is preferably cemented into, screwed into, or otherwise fastened to an underlying surface such as the ground 62. At the top of the post 16, a nut 66 or other fastening device is used to fasten over a top member (or cap) 68 of the post 16. Tightening the nut 66 secures the post 16 to the ground 62 or other underlying structure.

The vinyl beam reinforcement apparatus of the present invention is considered provide a significant advancement in the art of vinyl beam manufacturing and applications. The reinforced vinyl beam of the present invention is significantly stronger than vinyl beams that are not reinforced and thus is more favorable for use in standard vinyl beam applications as well as being suitable for many new applications for which standard vinyl beams are not sufficiently strong.

The reinforced vinyl beam of the present invention can be manufactured much more inexpensively than prior art reinforced vinyl beams due to the unique manner of inserting and retaining metal strips or members. The planar reinforcing strips or members can be manufactured inexpensively and can be of relatively inexpensive material. The reinforcing members can be economically dispensed within rolls or other arrangements and can be of any suitable gauge available off-the-shelf. Additionally, with the metal reinforcing members, the vinyl beams of the present invention provide greater security than standard vinyl beams, as they are much more difficult to penetrate.

The reinforced vinyl beam of the present invention prevents sagging, bowing, and other types of deformation of vinyl beams, especially where used in applications such as fences. The reinforcement apparatus and method also provides greater flexibility, allowing different configurations of reinforcement members within a vinyl beam according to the particular application. The metal reinforcement members have less surface area and therefore absorb less heat and have a much lower potential for deformation due to heat. Additionally, the metal members can join multiple vinyl beams, and could comprise separate members placed end to end.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A shaped thermoplastic beam, comprising:

a thermoplastic body formed with a cavity therein; and at least one retaining member integral to the thermoplastic body, the retaining member disposed within the cavity and forming a slot adapted to receive a substantially planar reinforcing member therein.

2. The shaped thermoplastic beam of claim 1, wherein the retaining member comprises a pair of lips attached to opposing walls of the thermoplastic body.

3. The shaped thermoplastic beam of claim 1, wherein the retaining member comprises a wall disposed within the cavity, the wall running from one outside wall of the cavity to the other and forming a fully enclosed sheath.

4. The shaped thermoplastic beam of claim 1, further comprising a substantially planar reinforcing member disposed within the cavity, the substantially planar reinforcing member comprising an edge, the edge disposed within the slot.

5. The shaped thermoplastic beam of claim 1, further comprising a plurality of retaining members disposed within the cavity and forming a plurality of slots for receiving a plurality of reinforcing members therein.

6. The shaped thermoplastic beam of claim 1, further comprising a plurality of cavities formed within the thermoplastic body, the plurality of cavities separated by one or more partition walls.

7. The shaped thermoplastic beam of claim 1, further comprising a plurality of substantially planar reinforcing members disposed within the cavity, the substantially planar reinforcing members each comprising an edge, the edge of each member disposed within a slot.

8. The shaped thermoplastic beam of claim 6, wherein the substantially planar reinforcing member abuts a partition wall.

9. The shaped thermoplastic beam of claim 1, wherein the reinforcing member abuts an exterior wall.

10. The shaped thermoplastic beam of claim 1, wherein the reinforcing member runs parallel with the beam.

11. The shaped thermoplastic beam of claim 1, wherein the thermoplastic body is formed of poly vinyl chloride.

12. The shaped thermoplastic beam of claim 1, wherein the reinforcing member comprises a metal strip.

13. The shaped thermoplastic beam of claim 12, wherein the metal strip comprises rolled steel.

14. The shaped thermoplastic beam of claim 1, wherein the thermoplastic body comprises a fence rail.

15. The shaped thermoplastic beam of claim 1, wherein the reinforcing member comprises a metal strip, the metal strip substantially preventing the thermoplastic body from sagging.

16. The shaped thermoplastic beam of claim 1, wherein a metal strip is adapted to reinforce the thermoplastic body.

17. A shaped thermoplastic beam, comprising:

a thermoplastic body formed with a cavity therein;

at least one retaining member integral to the thermoplastic body, the retaining member disposed within the cavity, the retaining member comprising a pair of lips attached to opposing walls of the thermoplastic body and forming a slot adapted to receive a substantially planar reinforcing member therein;

further comprising a substantially planar reinforcing member disposed within the cavity, the substantially planar reinforcing member comprising an edge, the edge disposed within the slot; and wherein the planar reinforcing member comprises a metal strip, the metal strip substantially preventing the thermoplastic body from sagging.

18. A shaped thermoplastic beam, comprising:

a thermoplastic body formed with a cavity therein;

at least one retaining member integral to the thermoplastic body, the retaining member disposed within the cavity, the retaining member comprising a wall disposed within the cavity, the wall running from one outside wall of the cavity to the other and forming a fully enclosed sheath adapted to receive a reinforcing member therein;

further comprising a substantially planar reinforcing member disposed within the cavity, the substantially planar reinforcing member comprising an edge, the edge disposed within the slot; and wherein the reinforcing member comprises a metal strip, the metal strip substantially preventing the thermoplastic body from sagging.

19. A method of reinforcing a thermoplastic beam, the method comprising:

providing a thermoplastic beam formed with retaining members, the retaining member disposed within the cavity and forming a slot adapted to receive a substantially planar reinforcing member therein; and inserting the reinforcing member into the slot.

20. The method of claim 19, wherein the reinforcing member is inserted at the time of installation of the thermoplastic beam and subsequent to the manufacture of the thermoplastic beam.

21. The method of claim 19, wherein the retaining member comprises a pair of lips attached to opposing walls of the thermoplastic body.

22. The method of claim 19, wherein the retaining member comprises a wall disposed within the cavity, the wall running from one outside wall of the cavity to the other closely proximate to one end of the cavity or to a center partition of the cavity, and forming a fully enclosed sheath adapted to receive the reinforcing member therein.

23. The method of claim 19, wherein an amount of the retaining members is selected according to the need in the application for strength and security.

24. A shaped thermoplastic beam, comprising:

a thermoplastic body formed with a cavity therein; and at least one diagonal interior wall integral to the thermoplastic body each diagonal interior wall emanating from a corner between two exterior walls and connecting with a central enclosure within the cavity of the thermoplastic beam, which enclosure is formed in the shape of a cylinder but may be formed in other shapes.

* * * * *

UNITED STATES PATENT AND TRADEMARK OFFICE

CERTIFICATE OF CORRECTION

PATENT NO. : 6,595,497 B1
DATED : July 22, 2003
INVENTOR(S) : Linford et al.

It is certified that error appears in the above-identified patent and that said Letters Patent is hereby corrected as shown below:

Drawings,
Figure 12, between blocks 804 and 806, should be numbered -- 805 --.

Column 2,
Line 11, "sense, because absent" should read -- sense, absent --.
Line 28, "insufficient the stuctural" should read -- insufficient structural --.

Column 3,
Line 27, "member form" should read -- members form --.

Column 5,
Line 30, "pickets disposed upper" should read -- pickets disposed on upper --.
Line 41, "Such Supports" should read -- Such supports --.

Column 6,
Line 22, "FIGS. 5 and 6" should read -- FIGS. 6A to 7A --.
Line 41, "handrail 25 similar" should read -- handrail similar --.
Line 41, "handrail 25 of" should read -- handrail of --.
Line 44, "handrail 25 is" should read -- handrail is --.
Line 46, "cavity 35*a* adjacent" should read -- cavity 35*b* adjacent --.

Column 7,
Line 34, "18*a*18*b*" should read -- 18*a*, 18*b* --.

Signed and Sealed this

Thirtieth Day of December, 2003

JAMES E. ROGAN
*Director of the United States Patent and Trademark Office*